United States Patent [19]

Cairns

[11] 4,330,300

[45] May 18, 1982

[54] COAL OIL MIXTURES

[75] Inventor: Roger J. R. Cairns, Woking, England

[73] Assignee: The British Petroleum Company Limited, London, England

[21] Appl. No.: 938,044

[22] Filed: Aug. 30, 1978

Related U.S. Application Data

[63] Continuation of Ser. No. 773,170, Mar. 1, 1977, abandoned.

[30] Foreign Application Priority Data

Mar. 5, 1976 [GB] United Kingdom ..... 08880/76

[51] Int. Cl.[3] ..... C10L 1/32

[52] U.S. Cl. ..... 44/51

[58] Field of Search ..... 44/51, 10 F

[56] References Cited

U.S. PATENT DOCUMENTS

| | | | |
|---|---|---|---|
| 1,390,232 | 9/1921 | Bates | 44/51 |
| 1,431,225 | 10/1922 | Greenstreet | 44/51 |
| 1,899,811 | 2/1933 | Kern | 44/51 |
| 1,939,587 | 12/1933 | Adam et al. | 44/51 |
| 2,668,757 | 2/1954 | Hansley | 44/51 |
| 3,241,505 | 3/1966 | Long et al. | 44/51 |

*Primary Examiner*—Patrick Garvin
*Assistant Examiner*—Y. Harris-Smith
*Attorney, Agent, or Firm*—Morgan, Finnegan, Pine, Foley and Lee

[57] ABSTRACT

Coal/oil gels are prepared by grinding coal in crude petroleum or a petroleum fraction. The gels are thixotropic and can be transported by pipeline.

9 Claims, No Drawings

COAL OIL MIXTURES

This is a continuation of application Ser. No. 773,170 filed Mar. 1, 1977, now abandoned.

This invention relates to the production of coal oil dispersions.

Coal oil slurries have previously been disclosed, see for example, British Pat. No. 975,687. Whilst these have behaved as near-Newtonian non-settling fluids in pipelines, they separate on standing. Thus such slurries are suitable for use immediately after preparation or pipelining but are not suitable for transportation by tanker nor for storage.

We have now discovered a method for the preparation of stable coal oil dispersions which are suitable for pumping and storage.

Thus according to the present invention there is provided a method for the preparation of a coal oil dispersion which method comprises grinding coal in a gas oil or heavier petroleum fraction medium until a stable dispersion results on ceasing grinding.

By "stable dispersion" is meant a dispersion which does not separate into layers of its constituent compounds on standing at ambient temperature for at least six months.

Grinding can be carried out in a vibratory or agitatory ball mill.

It is desirable to exclude air as much as possible during the grinding operation. This can be easily achieved in the case of vibratory ball milling by filling the mill with the oil first, followed by the balls and the coal. A suitable procedure is to fill the mill with the oil, add half the balls, then the coal and finally the rest of the balls. In the case of an agitatory mill, the balls should be added first, followed by the oil and then by the coal.

When using a ball mill, it is, of course, desirable to use balls made of a material which does not react with the coal and which does not wear unduly during the grinding. Ball mills usually contain steel or glass balls and these are suitable for the present purpose. It is preferred to use a hard grade of steel for the balls.

A magnetic filter can be used to remove small steel particles from the mix. A circulatory system can also be used wherein the slurry is pumped through an external magnetic filter and then returned to the mill.

Preferably the coal supplied to the grinding process is a bituminous coal of particle size less than 250 micron.

Preferably grinding is continued until the particle size is reduced to less than 10 micron. This time will usually not exceed 6 minutes. Particles greater than 10 micron in size may tend to settle out slightly on storage.

Preferably the amount of coal added is sufficient to give a coal oil dispersion containing up to 55% by weight of coal expressed as a % by weight of the total dispersion. Most preferably the amount of coal is sufficient to give a dispersion containing at least 15% by weight. If a coal concentration of greater than 55% by weight is exceeded then the resulting dispersion may be too solid-like for pumping.

Preferably the oil is a fuel oil, most preferably a fuel oil having a viscosity of not more than 3500 seconds, Redwood No. 1. The required viscosity may be achieved by "cutting back", if necessary.

Such coal fuel oil dispersions are suitable for use in blast furnaces, cement kilns end power stations.

Diesel oil may be used and the dispersions used as a fuel for low speed diesel engines. In this case the coal particles should be sufficiently small so as to be non-abrasive, i.e. less than 2 micron.

In the case of certain heavier fuel oil fractions it may be necessary to heat them in order to render them sufficiently mobile for use as a grinding fluid.

The invention is illustrated by the following examples.

EXAMPLE 1

A heavy fuel oil and a Botswana coal were chosen as the components of the dispersion.

The fuel oil was a 3500 seconds Redwood 1 fuel oil cut back with 35 seconds gas oil to give a 950 seconds product. It had the following properties:

| | |
|---|---|
| Pour point | 21° C. |
| Kinematic viscosity at 210° F. | 17.9 cSt |
| Kinematic viscosity at 170° F. | 37.8 cSt |
| Kinematic viscosity at 140° F. | 77.2 cSt |
| Specific gravity 60° F./60° F. | 0.953 |
| Water content | 0.6% by weight |

The coal was from the Morupule coal field, Reference C 6388. Box cut Reference ADA.

It had the following ultimate analysis.

| | |
|---|---|
| C | 59.7% by weight |
| H | 2.9 |
| O | 11.3 |
| S | 2.6 |
| N | 1.35 |
| Ash | 22.5 |

The coal was pre-ground to particles less than 250 micron in diameter, before grinding in the presence of the fuel oil.

Grinding was carried out in a stirred ball mill sold under the Trade Name "Dyno-Mill" Type KDL by Willy Bachofen Maschinefabrik, Basle, Switzerland. The mill comprises a cylinder of internal diameter 7.7 cm and length 15.0 cm. The cylinder is mounted with its axle in a horizontal position and the axle has three discs of diameter 6.4 cm mounted on it.

The cylinder was filled with 500 ml of 1 mm diameter steel balls.

Warm fuel oil at 60° C. (1 l) and ground coal (660 g) were dispersed in a high speed vortex mixer for 5 minutes. One liter of this mixture was pumped through the Dyno Mill in 3 minutes giving a pumping rate of 333 ml/min. The axle was rotated at 4,500 rpm to give a disc peripheral speed of 15 meter/sec.

The product was then collected and passed through the mill in 6.5 minutes i.e. at a lower flow rate. The procedure was repeated three more times at the initial flow rate giving five passes in total through the mill with a total residence time in the complete system of 18.5 minutes. The residence time of the mixture in the mill grinding chamber was about 6 minutes.

The resulting product was a thick, black, lustrous, homogeneous, semi-fluid material containing 41% by weight (32% by volume) coal. The coal particle size had been reduced to about 2 micron in diameter. The dispersion had a pour point of 27° C. It was a thixotropic material with a grease-like appearance. Rheological measurements indicated that it was a power law fluid with an immeasurably small yield stress. Eleven months after preparation the dispersion was still stable. During this period ambient temperature had varied between 18° and 33° C.

EXAMPLE 2

A sample of Illinois No. 6 coal was dispersed in a further sample of the 950 seconds Redwood No. 1 fuel oil of Example 1.

It had the following ultimate analysis.

| | |
|---|---|
| C | 71.1% by weight |
| H | 4.7 |
| O | 10.5 |
| S | 3.15% by weight |
| N | 1.4 |
| Ash | 10.0 |

The coal was preground to particles less than 400 micron in diameter before grinding in the presence of the fuel oil.

Grinding was carried out in a larger stirred ball mill sold under the Trade Name "Dyno-Mill" Type KD5 by Willy Bachofen Maschinefabrik.

Fuel oil (4 gallons) and preground coal (4.9 kilograms) were dispersed using a pitched circular disc mixer for 7 minutes to give a rough dispersion. This was initially pumped through the Dyno-Mill at 68 l/hour and then recycled at 34 l/hour. The total residence time in the mill grinding chamber was 6.6 minutes.

The resulting dispersion contained 28% by weight of coal and had an average particle size of about 2.5 micron.

Although prepared from a different coal and on a larger scale the product had a similar appearance and properties to that described in Example 1. The stability could not be checked over such a long period, but after 3 months there was no evidence of separation.

EXAMPLE 3

The oil was a sample of anthracene oil derived from coal pyrolysis which had been hydrogenated to a final level of hydrogen of 8% by weight. The viscosity of this oil was around 3 cSt at 100° F.

The coal was Illinois No. 6, the details of which are given in Example 2.

Grinding was carried out in the Dyno-Mill Type KDL.

The grinding chamber was filled with 500 ml 1 mm diameter carbon steel balls.

Hydrogenated anthracene oil (4660 g) was preground coal (1553 g) were dispersed using a high speed vortex mixer for 5 minutes at ambient temperatures. The mixture was then immediately pumped through the Dyno-Mill at a rate of around 100 ml/min and was recycled at a rate of 200 ml/minute (2nd pass) and finally at 130 ml/minute (3rd pass). The total residence time in the grinding chamber was 7–8 minutes. The resulting dispersion containing 25% weight/weight coal had an average particle size of around 2 micron.

After 3 months storage at ambient temperatures the coal had begun to separate out, as evidence by the formation of a thick sludge of around ¼" at the bottom of the container.

Example 3 is provided by way of comparison and is not according to the present invention.

It shows that when the oil is not a viscous petroleum fraction, an unstable dispersion is produced.

I claim:

1. A method for the preparation of a stable coal oil dispersion which is suitable for pumping and storage which method comprises grinding coal in fuel oil medium while excluding air until the particle size of the coal is reduced to a value below 10 micron and the dispersion contains 15 to 55% by weight of coal expressed as a percentage by weight of the total dispersion.

2. A method according to claim 1 wherein the coal is ground in the fuel oil medium until the particle size of the coal is reduced to a value in the range of 2 to 10 micron.

3. A method according to claim 1 or 2 wherein the coal is ground in the fuel oil medium until the particle size of the coal is reduced to a value of 2.5 micron.

4. A method according to claim 1 wherein the coal particle size prior to grinding is less than 250 micron.

5. A method according to claim 1 or 4 wherein the coal is bituminous coal.

6. A method according to claim 1 or 4 wherein the fuel oil is a fuel oil having a viscosity of nominally 3500 seconds Redwood No. 1 at 100° F. or lighter.

7. A method according to claim 1 wherein the stable coal oil dispersion is a gel possessing thixotropic properties.

8. A method according to claim 1 wherein the grinding is carried out in a ball mill.

9. A coal oil dispersion whenever prepared by a method according to claim 1.

* * * * *